United States Patent [19]

McGuire, Sr. et al.

[11] Patent Number: 4,635,464

[45] Date of Patent: Jan. 13, 1987

[54] TUBE BENDING MANDREL

[75] Inventors: Samuel B. McGuire, Sr., Carlsbad; Lee V. Jaderborg, Escondido, both of Calif.

[73] Assignee: Eaton Leonard Corporation, Carlsbad, Calif.

[21] Appl. No.: 771,973

[22] Filed: Sep. 3, 1985

[51] Int. Cl.[4] ..... B21D 9/03

[52] U.S. Cl. ..... 72/466

[58] Field of Search ..... 72/466; 411/385

[56] References Cited

U.S. PATENT DOCUMENTS

| | | | |
|---|---|---|---|
| 630,428 | 8/1899 | Wahlert | 411/385 |
| 1,683,573 | 9/1928 | Mueller et al. . | |
| 1,978,452 | 10/1934 | Flodin | 29/157 |
| 3,118,488 | 1/1964 | Barnhill | 153/40 |
| 3,190,106 | 6/1965 | Spates | 72/466 |
| 3,286,503 | 11/1966 | Garrett | 72/466 |
| 3,315,516 | 4/1967 | Sassak | 72/466 |
| 3,408,850 | 11/1968 | Maier et al. | 72/466 |
| 3,415,107 | 12/1968 | Ruscitti | 72/466 |
| 3,455,142 | 7/1969 | Roberts | 72/466 |
| 3,456,482 | 7/1969 | Maier et al. | 72/465 |
| 4,123,930 | 11/1978 | Hill et al. | 72/466 |
| 4,315,423 | 2/1982 | McGuire | 72/466 |
| 4,542,637 | 9/1985 | McGuire | 72/466 |

*Primary Examiner*—Lowell A. Larson

*Attorney, Agent, or Firm*—Gausewitz, Carr & Rothenberg

[57] ABSTRACT

A flexible tube-bending mandrel has a longitudinally-split shank link that is unthreaded, but recessed to receive a nut that threadedly engages the bolt for holding the link to a mandrel shank. The mandrel center links are longitudinally split for ease of assembly of their ball-and-socket interconnections and have their socket ends externally threaded to receive an internally-threaded ball segment that holds the center link sections in assembled condition and effectively restrains relative longitudinal motion of the two mating link sections.

18 Claims, 8 Drawing Figures

FIG. 3.
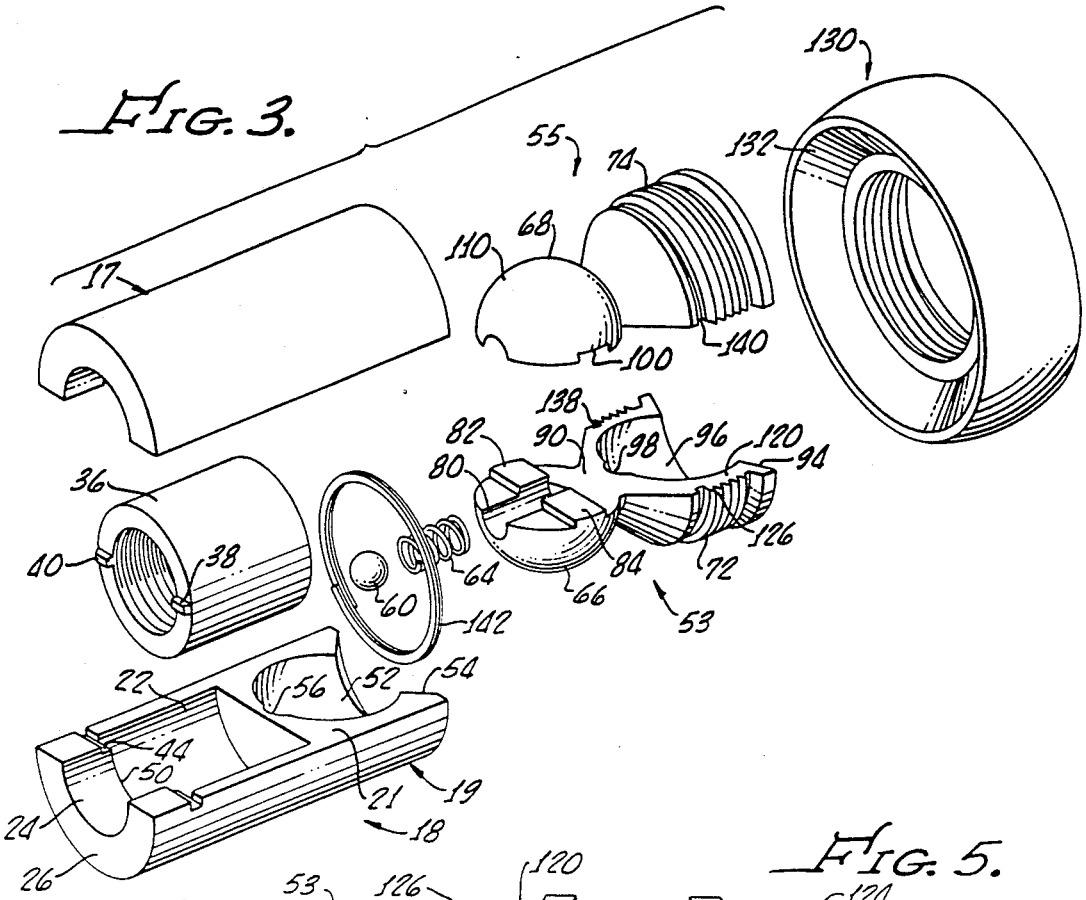
FIG. 5.
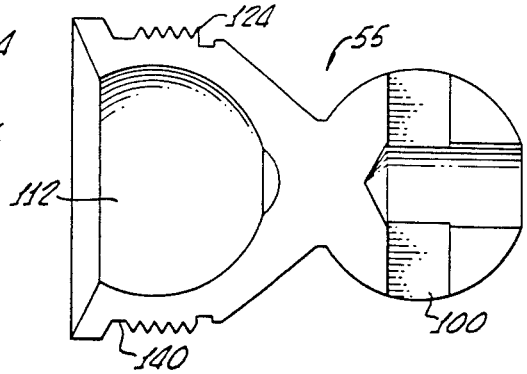
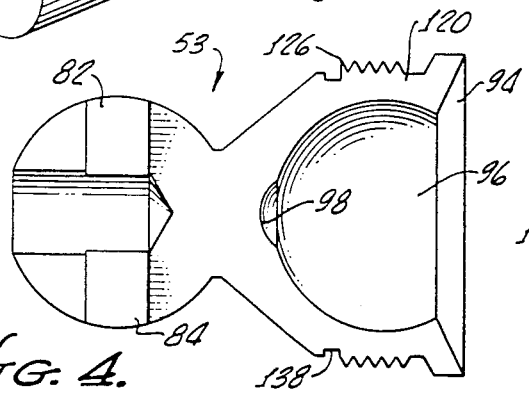
FIG. 4.
FIG. 7a.
FIG. 7b.
FIG. 6.
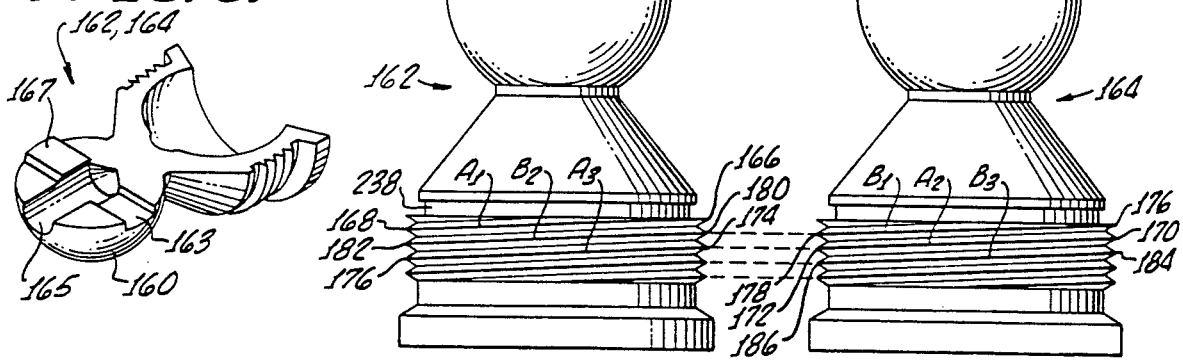

TUBE BENDING MANDREL

BACKGROUND OF THE INVENTION

The present invention relates to tube-bending mandrels, and more particularly concerns such a mandrel having ease of assembly and increased restraint against relative displacement of the assembled parts.

Tube-bending mandrels are widely employed to support the inside of a tube as it is being bent. The mandrel is inserted into the section of a tube that is to be bent, and as bending takes place, the mandrel, which is flexible, bends with the tube but supports the inside of the tube and prevents collapse or undue distortion. After completion of the bend, the mandrel is withdrawn, an operation that requires a very large force because the mandrel must be withdrawn through the bent portion of the tube. The bent portion of the tube has been somewhat distorted during the bending, partly by being forced to conform to the shape of the flexible mandrel sections, and therefore some of this distortion is necessarily removed by the withdrawing of the mandrel, thus increasing the resistance to such withdrawal.

The tube-bending mandrel commonly includes a straight section ending in a mandrel shank to which is connected a shank link. To the shank link are connected, in end-to-end relation, a number of articulated links generally of a ball-and-socket configuration. Mounted on these articulated links are ball segments which collectively form the outer surface of the flexible mandrel and provide the contact with the inner surface of the tube being bent. The flexible mandrel section, of course, must be readily assembled and disassembled. Partly because of the large forces involved, the parts are subject to relatively rapid wear. Thus, the mandrel may be disassembled frequently for repair and replacement of parts. For this reason, primary criteria dictating the design of the flexible mandrel are ease of assembly and disassembly. The desired ease of replacement of parts and the large forces experienced by the assembled device have resulted in many different configurations and constructions, developed for enabling assembly and disassembly of the mandrel linkage.

Longitudinally-split mandrel links have many features that facilitate assembly and disassembly. However, such arrangements suffer from disadvantages that derive from the longitudinally-split configuration. The U.S. Pat. No. 3,190,106, to Spates, illustrates a tube-bending mandrel employing longitudinally-split links, and also illustrates the disadvantages of such construction, which have led subsequent workers in the field to avoid the longitudinally-split link. The two halves of the center link, which abut along a longitudinal parting plane, are restrained against relative longitudinal sliding by a key and keyway. However, as previously mentioned, the mandrel is subjected to very large forces. Moreover, such forces are exerted on the device in many different directions, and seldom symmetrically. As the mandrel is withdrawn, the outer ball segments are frictionally restrained by the bent and somewhat disfigured surfaces of the bent tube section. Therefore, unless the key and keyways are precisely fit, mated and positioned, the two link haves are subject to longitudinal displacement, which may transfer relatively larger proportions of the applied forces to one of the link halves and lesser forces to the other. This results in more rapid wear, or even failure of the parts.

Another disadvantage of prior mandrel constructions is the large number of different parts that are employed. In order to assemble the ball-and-socket joints, each of the links must be made in two or more parts, fitting together in the manner of a three-dimensional jigsaw puzzle. In some constructions more than three sections are employed for each link. Thus, for repairability and replacement, one must maintain relatively large quantities and stocks of a number of different parts. This is expensive, time consuming and tends to greatly increase the chances of error in assembly if wrong parts are selected during the assembly process.

Accordingly, it is an object of the present invention to provide a strong, easily assembled and disassembled tube-bending mandrel that avoids, or at least greatly alleviates, the above-mentioned problems.

SUMMARY OF THE INVENTION

In carrying out principles of the present invention in accordance with a preferred embodiment thereof, a tube-bending mandrel has its links made of first and second mating link sections in face-to-face abutment along a longitudinal parting plane. A continuous external thread extends around the link sections at one end to receive an internally-threaded ball segment which accordingly restrains relative longitudinal motion of the mating sections. In one embodiment, the external threads are single lead threads having a thread starting point at precisely the same position on each of the link sections of a first half of a link, so that all of the sections of this half of the link are interchangeable. Similarly, the thread arrangement is identical on all of the sections of the other half of the link, so all of these sections are interchangeable.

In a second embodiment a double pitch, double lead thread is employed and arranged on the two longitudinally-split sections so that the two sections of the pair are identical. Accordingly, all sections of all pairs are identical, and only one type of part need be stocked to form the externally-threaded section halves of a plurality of links. Use of mating integral keys and keyways that are hermaphroditic enables the two halves to be precisely identical.

According to another feature of the invention, the shank link is longitudinally split but not threaded. Instead, it is provided with an internally-positioned threaded nut that is nonrotatably captured within the split shank link sections. Accordingly, the shank link sections are all identical and interchangeable for a given size mandrel.

BRIEF DESCRIPTION OF THE DRAWINGS

FIG. 3 is an exploded pictorial illustration of the shank link and a center link employed in the present invention;

FIG. 4 is a view of a male center link section;

FIG. 5 is a view of a female center link section;

FIG. 6 shows a center link section employing double pitch, double lead threads; and FIGS. 7*a* and 7*b* show the surfaces of two mating sections of the double pitch, double lead thread center link of FIG. 7*b*, illustrating the identity of the thread arrangements on the two mating halves.

DETAILED DESCRIPTION OF THE DRAWINGS

Figure 2:
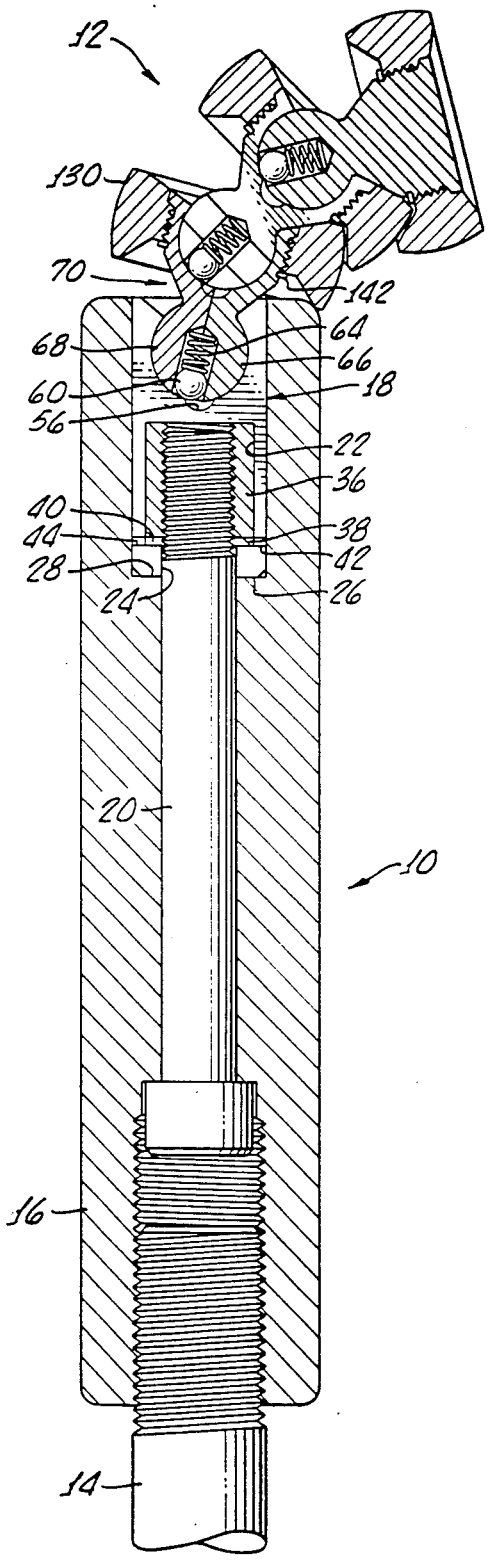
FIG. 2 is a view of the mandrel of FIG. 1 showing the bending of the flexible sections.
Figure 1:
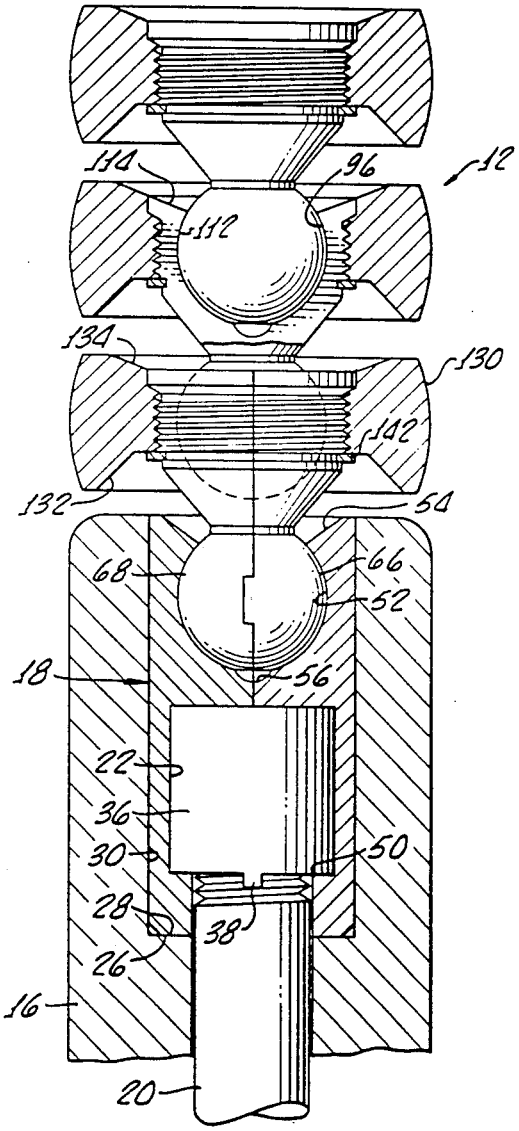
FIG. 1 is a sectional view of a portion of a typical tube-bending mandrel employing principles of the present invention and showing the mandrel sections all in straight alignment.

Illustrated in FIGS. 1 and 2 is a portion of an exemplary tube-bending mandrel part including a straight portion 10 and a flexible portion 12. The straight portion includes a mandrel rod 14 threadedly received within a threaded bore of a mandrel shank 16, which in turn is connected to a shank link 18 by means of a headed cap screw 20 that extends through a bore of the mandrel shank into threaded engagement with the shank link.

The shank link is formed of two mutually identical half-sections 17, 19 longitudinally contiguous along a longitudinally-extending parting plane. Each shank link section includes a body 21 (FIG. 3) having a semicylindrical, longitudinally-extending cavity 22 at one end which communicates with a shank bore half 24. The rear end of the shank link, the end at which the bore 24 is located, terminates in a flat end surface 26 that bears against a flat, forwardly-facing shoulder 28 formed at the rear end of a bore 30 of the mandrel shank. Bore 30 snugly receives the two shank link halves. A short, cylindrical, internally-threaded nut 36 is captured between and within the two shank link sections, being a snug fit within the mating cavities 22 of the two sections. Extending rearwardly from a rear flat face of the nut 36 are a pair of diametrically disposed ribs 38, 40 which are mutually aligned with one another and which are received in shank link grooves 42, 44, which are similarly diametrically disposed and mutually aligned, extending transversely in each of the two identical shank link sections. Cap screw or bolt 20, when threadedly engaged in the nut 36, pulls the nut toward the mandrel link 16, and accordingly, by means of the bearing of the end face 26 of the nut upon a forwardly-facing, circumferentially-extending shank link shoulder 50, urges the shank link end face 26 against the forwardly-facing shoulder 28 of the mandrel link to firmly secure the latter to the mandrel shank. Ribs 38, 40, received in grooves 42, 44, prevent relative rotation of the nut and shank link sections.

The forward end of each shank link section is formed with a semicircular cavity 52 that merges into a forward, conically-tapered shank link entrance surface 54 which permits flexing of a longitudinally-split center link (to be described below) that is formed of mating link sections 53, 55 and connected to the shank link. The rear end of the semicircular cavity section 52 is formed with a partly spherical ball detent recess 56, which cooperates with the corresponding recess on the mating shank link section to receive a ball detent 60 urged into the detent recess by a spring 64. The spring 64 is captured within and between ball end sections 66, 68 of a first or rearmost split center link 70 having socket end sections 72, 74, respectively, formed integrally with the ball end sections 66, 68. The ball end of the center link section 53, shown in FIG. 4, which may be termed a male link section, is formed as a solid, substantially hemispherical body having one-half of a cylindrical bore 80 for receiving spring 64. A transverse male key having sections 82, 84 is integrally formed with the ball end section 66, with the two key sections being mutually aligned and positioned on either side of the spring cavity section 80. The socket end section 72 of center link section 53 is integrally connected to the ball end section by a relatively narrow neck 90 that flares outwardly and forwardly therefrom to form the socket end which terminates in a conically-tapered entrance 94. The entrance 94, like the entrance 54 of the shank link, leads into a semispherical cavity 96 for the male center link section, having a portion of a ball detent recess 98 formed in a centrally-positioned rear end thereof.

Other than its opposite hand threads (described below) and its keyway, female section 55 of center link 70 is identical to the male section 53. The female section is formed with a female keyway 100 (instead of the male key) transversely extending across the center link section and positioned to precisely receive and mate with the key sections 82, 84 of the male section. Like the male center link section, the female section includes a hemispherical ball section 110 having half of a cylindrical recess which mates with the recess 40 to receive spring 64. The female link section also has a socket link end formed with a mating hemispherical recess 112 and a mating, conically-tapered entrance surface 114, and is provided with the mating half of a ball detent receiving recess. The two center link sections abut one another along a longitudinally-extending parting plane that runs along the mating surfaces such as surface 120 of the male section, and which divides the center link section into nearly identical symmetrical portions, being identical and symmetrical except for male and female arrangements of the keyway and for differences in the external threads, as will be presently described.

The mating sections of the center link are externally threaded with a thread that uniquely starts at a thread starting point having a fixed circumferential position and a fixed longitudinal position. As seen in FIG. 4, the thread of the male center link section has a thread starting point 126, which is positioned on the parting plane, or, in other words, just at the edge of the center link section where the outer circumferential surface intersects the flat inner surface that extends along the parting plane. Not only is the thread starting point 126 fixed circumferentially, but it is fixed longitudinally, being positioned at a fixed distance from a longitudinal reference. This reference may be conveniently taken to be the transverse centerline of the key sections 82, 84. The thread starting points for all male center link sections are precisely the same, both circumferentially and longitudinally, whereby all sections of a group of male center link sections are precisely identical to each other and completely interchangeable with one another.

The female center link section 55, as illustrated in FIG. 5, is precisely identical to the male center link section except for the provision of a keyway 100 instead of a key, and except for the positioning of the threads. The threads of the female center link section are the same as the threads of the male center link section, except that the threads on the two sections are of opposite hand. Thus, the female center link section 55 has a thread starting point 124 that is positioned at the parting plane of the section and at a fixed distance from a longitudinal reference point, which in this case is the centerline of the keyway 100. The two starting points 124, 126 of the male and female sections are at the same point of the assembled sections. The longitudinal position of the two starting points is precisely the same for both sections. Thus, the distance between the starting point for each of the male and female sections and the key centerline for the one and the keyway for the other is the same. Therefore, because the thread starting points for all female sections are the same circumferentially and longitudinally, all center link female sections are identical with all other center link female sections. If the starting points were not chosen as described above, it would be necessary to identify specific male and female sections forming a given pair, and, when disassembled, one particular male section would have to be tied or otherwise identified to its one and only mating female section. With the described precise control of the thread starting point, on the other hand, any male section will mate with any female section, and thus one need only separate male and female sections.

A one-piece internally threaded ball segment 130 has a relatively deep, tapered recess at its rearward surface 132 and a relatively shallow, tapered recess at its forward surface 134 (see FIGS. 1 and 2).

The threads on the mating male and femle center link sections 53, 55 engage the internal threads of the ball segment 130, which is forwardly rotated for assembly on the mating sections after being inserted over the ball end. A locking groove 138 extends peripherally around the socket end of the male section immediately to the rear of the thread and a corresponding locking groove 140 is similarly positioned on the female section to receive a lock ring 142 (not shown in FIG. 3) that maintains the ball segment in its threaded engagement with the two center link sections.

The external threading of the center link, to engage the internally-threaded ball segment, uniquely cooperates with the longitudinally-split center link sections to perform several important functions. The ball segment, by being threaded on the link sections, holds the two sections of the center link in assembled relation. More importantly, the ball segment, together with its internal threads that engage the external threads of the center link sections, insures equal transmission of forces to both of the longitudinally-split sections. If the key or keyways should become worn or misaligned, or otherwise arranged so as to allow slight longitudinal motion of one center link section relative to the other, the very large forces experienced as the mandrel is withdrawn may all be exerted on only one of the link sections, resulting in excessive wear or destruction of the longitudinally-split link. With the described external threading of the link sections and the ball segment assembled thereon, the threads provide a much greater area of axially-directed bearing surfaces than the transverse key and provide significantly greater resistance to relative longitudinal motion of the two center link sections. Thus, the external threading of the center link sections assist the key and keyway in maintaining alignment of the mating link sections.

Moreover, the threaded engagement of the ball segment with the externally-threaded center link sections insures a positive restraint against relative motion of the ball segment and the center link sections in the presence of forces exerted in either direction, whether pulling or pushing the mandrel. In some situations, particularly where one bend is to be made tangent to a prior bend, it may be necessary to forcibly push the mandrel through the pipe into a previously-bent portion. In such a situation, the mandrel will be subjected to large forces both in driving the mandrel into the pipe and withdrawing it from the pipe. The illustrated arrangement of threaded interconnection between the ball segment and the longitudinally-split center link sections resists such forces, whether in one direction or the other. In prior arrangements, on the other hand, where the ball segment is held on the center link sections by a lock ring or the like, which is designed to resist forces exerted when pulling the mandrel, the forces experienced in driving a mandrel into the pipe may be too great to be resisted by the lock ring, and the ball segment may be dislodged from the link socket end.

The center link sections illustrated in FIGS. 1–5 provide for a longitudinally-split link which is most easily assembled, and furthermore provides for a minimum of different parts. As previously described, all of the male center link sections are identical to each other and all the female center link sections are identical to each other, so that there are needed only two different kinds of center link sections. The two different center link sections may be made even more similar to one another by eliminating the integral arrangement of the male key. In other words, both sections of a center link would have a keyway, just as does the female section described above. Neither would have a permanently-fixed key. Instead, a relatively loose key would be provided, to be inserted in the two mating parts upon assembly. In such an arrangement, even though the two sections are more closely identical to each other, the two would still have opposite-hand threads so that the parts would not be precisely identical. As still another alternative, the hermaphroditic keying arrangement of FIG. 6 (described below) may be used with the split center link of FIGS. 1–5.

Illustrated in FIGS. 6, 7*a* and 7*b* is a longitudinally-split center link arrangement in which the two link half-sections 162, 164 are, in fact, fully and completely identical, so that any center link half-section, whether right side or left side, can be assembled with any other center link section. With this configuration, one need not separately store differently-configured center link sections. Each center link section includes a ball end 160, which, except for the key arrangement, may be identical to the ball end of the male or female section previously described. In FIGS. 6 and 7, however, the transverse keying arrangement employs an hermaphroditic configuration having a female keyway section 163 on one side of the semicylindrical spring receiving bore 165 and an integral male key section 167 on the other side of the bore, in alignment with keyway section 163. The other mating section of this center link 162, 164 has the identical keying arrangement so that when the two sections are face to face, the integral key of one is received in the keyway of the other. Alternatively, both sections may be made with female keyways with a loose key being received in both. However, the loose key adds one more part and is not as strong as an integral key. The key arrangement of FIGS. 6 and 7 can readily be used in many other split link mandrels, including the mandrel shown in FIGS. 1–5 above.

The socket end each of sections 162, 164 is internally identical to the socket ends previously described. However, the external thread is made as a double pitch, double lead thread. With the use of such a double pitch, double lead thread, and insuring that each thread starts at an identical thread starting point, both circumferentially and longitudinally, the two center link sections are, in fact, fully and totally identical. FIGS. 7*a* and 7*b* illustrate a pair of identical center link sections 162, 164 in side-by-side relation. Each external thread arrangement of a full link (two sections) includes a first thread lead $A_1$, $A_2$, $A_3$, etc., and a second thread lead $B_1$, $B_2$, $B_3$, etc. A first thread lead such as $A_1$ on section 162 extends from a starting point 166 at a parting line on one side to a point 168 at the parting line on the other side of the same section 162. At point 168, thread lead $A_1$ meets and continues at point 170, the beginning of lead $A_2$ on section 164. This continues to a point 172 on the parting line on the other side of the second section 164. Point 172 on section 164 mates with the point 174 on the section 162 (when assembled) and continues along lead portion $A_3$. Similarly, the first thread lead $B_1$ on the second section 164 has a thread starting point 176 at one parting line and continuing to point 178 on the other parting line of section 164. This thread lead continues at point 180 at one parting line of section 162 and continuing along $B_2$ to point 182. Point 182 of section 162 mates with point 184 of section 164, and this thread lead then continues along thread lead $B_3$ to point 186 at the other parting line of the second section 164. Thus, it will be seen that the thread starting point 166 for the first lead of section 162 is positioned precisely circumferentially and longitudinally the same as thread starting point 176 of the first lead of the second section 164. The two center link sections are exactly identical, even to the positioning of the thread, and when the two parts are mated along the parting plane, the first thread lead starts at point 166 and the second thread lead starts at point 176, which is diametrically opposed to point 166 but slightly displaced longitudinally. The internal threads of the one-piece mating ball segment (not shown) are arranged to mate with the double lead, double pitch threads of each assembled center link.

Accordingly, it will be seen that with the use of the described double pitch, double lead thread having thread lead starting points that are precisely the same for all the center link sections, only one configuration of center link section is necessary, and any pair of such sections may be mated and assembled to threadedly receive a circumscribing ball segment that is identical to those previously described, except, of course, for the internally threading, which must match the threading of the assembled center link sections.

It will be seen that there have been described several versions of an improved tube-bending mandrel which has greatly increased ease of assembly and disassembly by virtue of its use of longitudinally-split shank links and longitudinally-split center links, and yet requires a minimum of parts. The split sections of the shank link are precisely identical to one another. In one embodiment all male sections of the center link are identical to all other male sections and each may be used with any one of the center link female sections, all of which are identical to each other female center link section. In a second embodiment, all the center link sections, whether on one side or the other, are identical, and no distinction need be made between any one center link section and another. Moreover, each identical section has an integral male key. The external threading of the longitudinally-split center link sections allow retention of the advantage of ease of assembly of the split sections and yet ensures maximized strength of the center links and maximized resistance to relative longitudinal displacement of split center link sections. It also provides maximized bidirectional resistance to displacement of the ball segment from the center link.

Although the embodiment of FIGS. 6 and 7 is preferred at present, for newly-made mandrels, the single thread arrangement of FIGS. 1–5 is preferred for retrofitting present mandrels having single thread ball segments.

The foregoing detailed description is to be clearly understood as given by way of illustration and example only, the spirit and scope of this invention being limited solely by the appended claims.

What is claimed is:

1. A tube-bending mandrel comprising, a plurality of links, each having a ball end and a socket end, each said link being formed of first and second mating link sections positioned in face-to-face abutment with each other along a parting plane that extends longitudinally from the ball end to the socket end, the socket ends of a mating pair of said links sections having formed thereon continuous external threads having an axis extending longitudinally of the link sections, said threads running around the circumference of the link sections at said socket portion, the ball end of a first one of said links being positioned within the socket end of an adjacent one of said links, and an internally-threaded ball segment threaded on said socket end threads, whereby said ball segment holds mating link sections together in assembled relation and restrains relative longitudinal motion of said mating sections.

2. The mandrel of claim 1 wherein each section of a group of said first link sections are mutually identical, each such section having the threads thereof starting at a thread starting point that is circumferentially positioned relative to the parting plane identically for each of such first link sections, whereby the first link sections of such group are mutually interchangeable to enable any one of such group of first link sections to cooperate with a second link section and provide therewith a complete set of threads for receiving a threaded ball segment.

3. The mandrel of claim 2 wherein each section of a second group of said second link sections each has the threads thereof starting at a thread starting point that is circumferentially positioned with respect to the parting plane at the same position for all of the second link sections of said second group, whereby any one of said second link sections can cooperate with any one of said first link sections to form therewith a complete set of threads for receiving a threaded ball segment thereon.

4. The mandrel of any one of claims 1, 2 or 3, wherein each of said first link sections includes an integral key extending transversely of said parting plane, and wherein each of said second link sections includes a transverse keyway adapted to mate with the key of any one of said first link sections, whereby said key and keyway and said threads of said socket ends and ball segments act to restrain relative longitudinal motion of said mating link sections.

5. The tube-bending mandrel of any one of claims 1, 2 or 3 including keying means on said first and second mating link sections of each said link extending transversely of said parting plane, whereby to further restrain relative longitudinal motion of said mating sections.

6. The mandrel of claim 2 wherein each section of a group of sections has an hermaphroditic keying arrangement which includes an integral key and a keyway aligned with said key, both formed on a single section.

7. A tube-bending mandrel comprising, a plurality of interconnected ball-and socket links each having a ball end and a socket end, a mandrel shank, and a shank link interconnecting one of said ball-and-socket links with said mandrel shank, said shank link comprising, first and second mating shank link sections positioned in face-to-face abutment with each other along a parting line, said shank link sections being formed at one end thereof with a socket receiving the ball end of one of said ball-and-socket links, and a nut captured within and between said shank link sections, and an attaching bolt extending from said mandrel shank into said nut, each of said shank link sections being identical to the other and all being interchangeable with one another.

8. The tube-bending mandrel of claim 7 wherein each shank link section is formed with a section of a cylindrical cavity, the cavities of a mating pair of said shank link sections cooperating to form a cylindrical cavity in which said nut is received and captured.

9. The tubing bending mandrel of claim 7 including cooperating means on said nut and at least one of said shank sections for restraining relative rotation of said nut and said one shank section.

10. The tube-bending mandrel of claim 9 wherein said means for restraining relative rotation comprises, a transverse slot formed in at least one of said shank sections and a projecting rib extending from the end of said nut and received in said transverse slot.

11. The mandrel of claim 7 wherein each said shank section is formed with a circumferential shoulder within said cavity section, said circumferential shoulders abutting an end of said captured nut, thereby to transfer axial force applied to said nut by a bolt inserted therein to said shank link.

12. A tube-bending mandrel comprising, a mandrel shank, a shank link secured to said mandrel shank, and a plurality of center links connected to one another in end-to-end relation, and having one of said center links connected to said shank link, each said center link having a socket formed on one end thereof and a ball integrally formed on the other end thereof, each said center link being formed of first and second mating link sections in face-to-face abutment with each other along a parting line that extends from the ball end to the socket end, the socket end of each of a group of said center links being formed with a continuous external thread having a starting point at a first link section, the starting point of the threads for each of a group of said first link sections having the same circumferential position relative to the parting plane, the link sections of said first group of link sections being mutually identical and interchangeable whereby any one of such link sections will cooperate with a second link section to form an operative center link, and a ball segment threaded on at least one of said center links.

13. The tube-bending mandrel of claim 12 wherein each of said center links is formed with a double pitch, double lead thread, each section of said group of first link sections being identical to each other and to each section of said second link sections, whereby any one of said first and second link sections is interchangeable with any other one of said link sections so that any pair of said link sections may be mated to one another to form a complete thread for operatively receiving a ball segment.

14. A tube-bending mandrel comprising, a mandrel shank, a shank link secured to said mandrel shank, and a plurality of center links connected to one another in end-to-end relation, and having one of said center links connected to said shank link, said shank link comprising, first and second mutually identical shank link sections in face-to-face abutment along a parting line, each said section having a ball cavity section at one end thereof, said ball cavity sections cooperating to receive a ball end of one of said center links, a nut captured within and between said shank link sections, means for restraining relative rotation of said nut and said shank link sections, and a threaded bolt extending from said mandrel shank into threaded engagement with said nut.

15. A tube-bending mandrel comprising, a plurality of links, each having a ball end and a socket end, each said link being formed of first and second mating link sections positioned in face-to-face abutment with each other along a parting line that extends from the ball end to the socket end, the socket ends of a mating pair of said link sections having formed thereon double pitch, double lead external threads extending continuously around the circumference of said socket end, the threads of each link section having a longitudinal and circumferential starting point that is the same for all of a group of said link sections, all of the link sections of said group being mutually identical and interchangeable, whereby any two of the link sections of said group may be mated to provide a set of external threads, and an internally threaded ball segment threaded on said double lead, double pitch threads, whereby said ball segment holds the mating link sections together in assembled relation and restrains relative longitudinal motion of said mating sections.

16. The tube-bending mandrel of claim 15 wherein each section of said group of mutually identical sections is formed with a transverse keyway adapted to mate with the keyway of a mated section, and a key positioned in each pair of mating keyways, said key being removable from each of said keyways.

17. The mandrel of claim 16 wherein each section of a group of mutually identical sections has an integral key extending transversely across a part of such section and a keyway aligned with said key and extending transversely across another part of such section.

18. The mandrel of claim 15 wherein each section of a group of said link sections is formed with an hermaphroditic keying arrangement comprising an integral key aligned with a keyway.

* * * * *

UNITED STATES PATENT AND TRADEMARK OFFICE

CERTIFICATE OF CORRECTION

PATENT NO. : 4,635,464

DATED : January 13, 1987

INVENTOR(S) : Samuel B. McGuire and Lee V. Jaderborg

It is certified that error appears in the above-identified patent and that said Letters Patent is hereby corrected as shown below:

Claim 1 (column 8, line 12), delete "links" and insert —link—.

Signed and Sealed this

Twenty-first Day of April, 1987

*Attest:*

DONALD J. QUIGG

*Attesting Officer*

*Commissioner of Patents and Trademarks*